US008517478B2

(12) United States Patent
Diemel et al.

(10) Patent No.: US 8,517,478 B2
(45) Date of Patent: Aug. 27, 2013

(54) MEDICINE CABINET WITH COLD STORAGE REGION

(75) Inventors: Douglas J. Diemel, Philadelphia, PA (US); Herbert V. Kohler, Jr., Kohler, WI (US)

(73) Assignee: Robern, Inc., Bristol, PA (US)

( * ) Notice: Subject to any disclaimer, the term of this patent is extended or adjusted under 35 U.S.C. 154(b) by 766 days.

(21) Appl. No.: 12/116,422

(22) Filed: May 7, 2008

(65) Prior Publication Data

US 2008/0278047 A1 Nov. 13, 2008

Related U.S. Application Data

(60) Provisional application No. 60/928,009, filed on May 7, 2007.

(51) Int. Cl.
*A47B 97/00* (2006.01)
*A47B 67/00* (2006.01)
*A47B 96/04* (2006.01)

(52) U.S. Cl.
USPC ..... 312/291; 312/227; 312/401

(58) Field of Classification Search
USPC ..... 312/291, 224–227, 242, 403, 400, 312/401; 62/291, 441, 275
See application file for complete search history.

(56) References Cited

U.S. PATENT DOCUMENTS

| | | | | |
|---|---|---|---|---|
| 451,346 | A | 4/1891 | Tweeddale | |
| 2,216,873 | A * | 10/1940 | Browne | 454/183 |
| 2,554,290 | A | 5/1951 | Becker | |
| 2,575,530 | A * | 11/1951 | Reid | 312/225 |
| 2,678,252 | A * | 5/1954 | Swearingen | 312/223.5 |
| 2,997,354 | A * | 8/1961 | Hough | 312/310 |
| 3,008,785 | A * | 11/1961 | Gehrs | 312/209 |
| 3,140,134 | A * | 7/1964 | Nairn | 312/204 |
| 3,521,936 | A * | 7/1970 | Coker, Jr. | 312/209 |
| 3,732,702 | A * | 5/1973 | Desch | 62/3.6 |
| 4,457,140 | A | 7/1984 | Rastelli | |
| 5,048,900 | A * | 9/1991 | Nunn | 312/114 |
| 5,277,039 | A | 1/1994 | Haasis | |
| 5,622,059 | A * | 4/1997 | McClellan | 62/448 |
| 5,647,651 | A * | 7/1997 | Kim | 312/291 |
| 5,694,785 | A * | 12/1997 | Balentine | 62/275 |
| 6,484,512 | B1 | 11/2002 | Anderson et al. | |
| 6,532,757 | B2 | 3/2003 | Holzer et al. | |
| 6,636,780 | B1 | 10/2003 | Haitin | |
| 6,640,572 | B2 | 11/2003 | Doran | |

(Continued)

FOREIGN PATENT DOCUMENTS

| | | |
|---|---|---|
| CN | 2189728 Y | 2/1995 |
| CN | 2499760 Y | 7/2002 |

(Continued)

OTHER PUBLICATIONS

"Thermospa Refrigerator Cabinet for Your Bathroom!!", by Nandini Maheshwari, http://www.bornrich.com/entry/thermospa-refrigerator-cabinet-for-your-bathroom/, Aug. 21, 2006.*

*Primary Examiner* — Janet M Wilkens
*Assistant Examiner* — Timothy M Ayers
(74) *Attorney, Agent, or Firm* — Foley & Lardner LLP

(57) ABSTRACT

A medicine cabinet has refrigeration capability for storing sensitive bathroom items. An evaporation tray is provided to receive condensation from the refrigeration system and evaporate it to the atmosphere without disrupting ornamental characteristics. The refrigerator compartment is preferably a modular unit.

9 Claims, 4 Drawing Sheets

(56) References Cited

U.S. PATENT DOCUMENTS

| | | | | |
|---|---|---|---|---|
| 6,640,581 | B1 * | 11/2003 | Choi | 62/440 |
| 6,715,299 | B2 * | 4/2004 | Kim et al. | 62/3.6 |
| 6,769,260 | B2 * | 8/2004 | Kim et al. | 62/3.6 |
| 6,840,592 | B2 * | 1/2005 | Kalieta et al. | 312/326 |
| 7,178,354 | B2 | 2/2007 | Bretschneider et al. | |
| 2004/0140744 | A1 | 7/2004 | Kalieta et al. | |

FOREIGN PATENT DOCUMENTS

| | | |
|---|---|---|
| DE | 20210466 | 9/2002 |
| DE | 8423110 | 11/2008 |
| JP | 2002263015 | 9/2002 |
| JP | 2006250379 | 9/2006 |

* cited by examiner

MEDICINE CABINET WITH COLD STORAGE REGION

CROSS-REFERENCE TO RELATED APPLICATIONS

This application claims benefit to U.S. Provisional Application Ser. No. 60/928,009, filed May 7, 2007.

STATEMENT OF FEDERALLY SPONSORED RESEARCH OR DEVELOPMENT

Not applicable.

BACKGROUND OF THE INVENTION

This invention relates to medicine cabinets having a refrigerated storage space.

Medicine cabinets are conventionally positioned along the walls of bathrooms. They typically have a mirror on an external door, the door being hinged to provide access to the cabinet interior. When the door is swung open a storage space is exposed inside the cabinet, typically one having shelves on which are positioned drugs, cosmetics and other items useful in the bathroom.

Some sensitive cosmetics and other perishable bathroom items are designed to be stored only at refrigerated temperatures. Still others can be stored at some ambient temperatures, but not at the temperatures experienced during the summer in some tropical or desert climates. Thus, consumers will often split such items between those placed in conventional medicine cabinets and those placed in a conventional household refrigerator. However, this approach has a number of deficiencies.

For one thing, it is somewhat inconvenient to have to place sensitive items in two different locations. Someone may forget where the items are kept, or that the items are still available since the items may become hidden behind other items (e.g., food) and forgotten about.

Moreover, household refrigerators are often accessible by children. It often is desirable to place sensitive or harmful items away from areas that young children frequent. For example, it is preferred to have certain items kept only in the parent's bathroom, and thus less likely to be encountered by young children.

Further, there may be privacy concerns if certain items are kept in the house's main refrigerator. For example, if a guest opens the household refrigerator they may learn private information about those in the house.

One idea to address these concerns is to provide a mini bar type refrigerator in a bathroom. This is the approach taken by Biszet, where they sell a small floor refrigerator provided with a mirror on its outer door to make it appear to be more suitable for a bathroom environment. However, this concept uses up floor room in the bathroom. Often, there is no extra floor room available for this purpose.

In U.S. Pat. No. 6,636,780 there was a disclosure of a medicine cabinet which could have positioned near it an expansion unit capable of acting as a refrigerator for bathroom items and the like. However, this system required a separate construction for the refrigerator, and was not compact.

A variety of multi-purpose furniture items have been developed for use in rooms outside of the bathroom where there was at least some refrigeration capability provided as part of the furniture item. See e.g. U.S. Pat. Nos. 2,554,290, 4,457,140, 5,277,039, 6,640,572, 6,484,512, 6,532,757 and 7,178,354. Most were for positioning on the floor. Even where wall mounting was suggested the designs were not compact, and thus not desirable for bathroom use.

Hence, there is a continuing need for improved medicine cabinets, particularly one which is wall mountable, compact and capable of providing both ambient and refrigerated storage in an ornamentally acceptable manner.

SUMMARY OF THE INVENTION

In one embodiment the invention provides a wall-mountable medicine cabinet. It has an outer cabinet housing having a front opening covered by a movable door. There is also a refrigeration system for cooling a first portion of the housing interior while not cooling a second portion of the housing interior.

The first portion is configured to store items at a refrigerated temperature within the cabinet. The second portion is configured to store items at essentially ambient temperatures within the cabinet. By "essentially ambient" we mean the temperature that the storage area would have absent imposed cooling or heating.

The medicine cabinet may have its door mirrored on an outer surface to make it appear as if it is a conventional, non-refrigerated medicine cabinet. Further, decorative woods and other ornamental treatments may be applied to its exterior.

In preferred forms the refrigeration system is provided with an assembly to collect condensation from the refrigeration system and evaporate the condensation into the air. There preferably is an electrical heater to evaporate condensation into the air. Where the refrigeration system is in the form of a modular cabinet unit, there can be a drip pan in the modular cabinet unit, a conduit to carry condensation from inside the modular cabinet unit to outside the modular cabinet unit, another drip pan outside the modular cabinet unit, and an electrical heater for facilitating evaporation of condensation from the second drip pan.

In an alternative aspect the invention provides a wall-mountable medicine cabinet with an outer cabinet housing having a front opening covered by a movable door. There is also a refrigeration system for cooling a first portion of the housing interior.

The refrigeration system is preferably in a modular cabinet unit, where there is a drip pan in the cabinet unit, a conduit to carry condensation from inside the cabinet unit to outside the cabinet unit, another drip pan outside the cabinet unit, and an electrical heater for facilitating evaporation of condensation from said another drip pan.

In addition to providing a compact wall mountable medicine cabinet with refrigerated storage (and optionally also ambient storage space), the present invention provides a unique construction to address the problem of condensation in this unique environment, without significantly disrupting the ornamentation of the design.

Where the refrigeration unit is made modular the remainder of the cabinet can still be marketed without it, without significant modifications. This provides an additional cost savings where a line of medicine cabinets are to be commercialized.

These and still other advantages of the present invention will become more apparent, and the invention will be better understood, by reference to the following description of the preferred embodiments of the present invention which follows (with reference to the accompanying drawings).

DETAILED DESCRIPTION OF THE PREFERRED EMBODIMENT(S)

Figure 1:
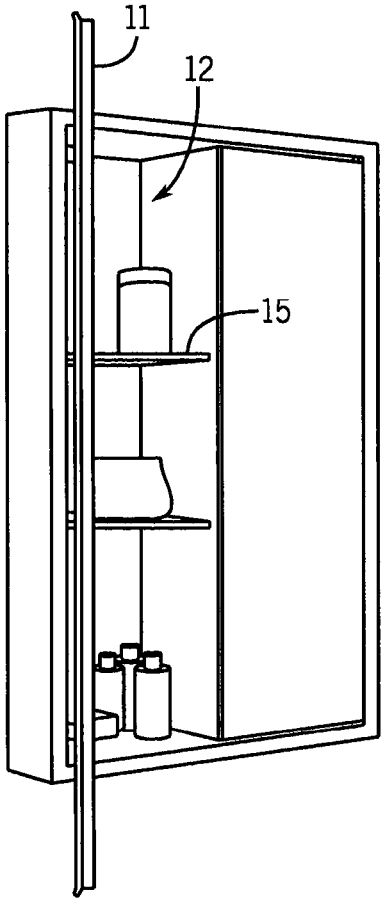
FIG. 1 is a perspective view of a medicine cabinet of the present invention, with its outer door opened.

The drawings show a medicine cabinet, generally 10, having a main front door 11 hinged to the cabinet, preferably either at the left or right side thereof, a left side hinge mounting being shown in the drawings. The front of the door may be mirrored and the door covers over both ambient storage space 12 and refrigerated storage space 13.

When the door 11 is opened (as shown in FIG. 1), shelves 15 can be accessed. On top of them can be placed cosmetics 16, toiletries 17 and the like which are to be stored at ambient room temperature. There is also a refrigeration unit 20 in the form of an elongated cabinet 21 having a door 22 hinged to it. The front of the door 22 may be mirrored.

Figure 2:
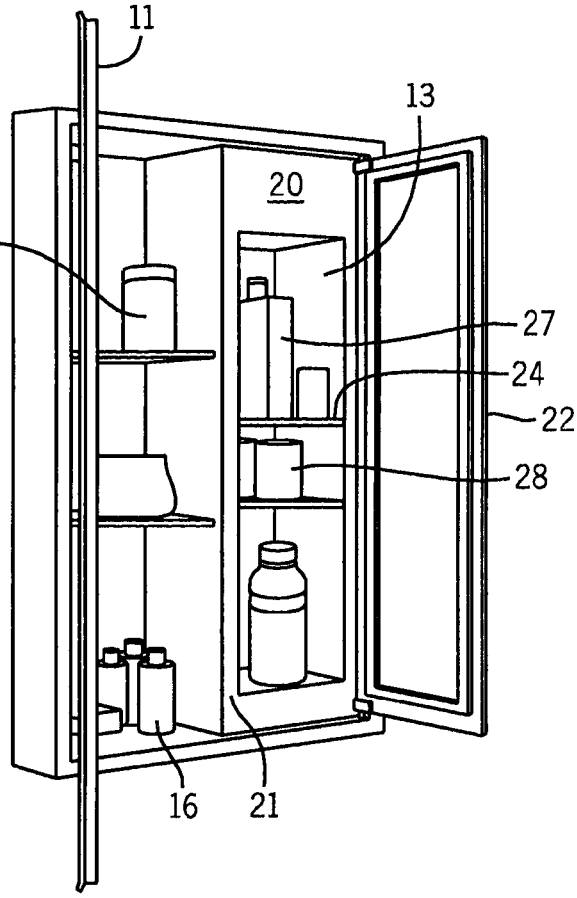
FIG. 2 is a view similar to FIG. 1, but with an inner cold storage door also open.

When the door 22 is opened (as shown in FIG. 2), refrigerated storage space 13 may be accessed, such as shelves 24 therein. Sensitive cosmetics 27, toiletries 28 and the like that need to be refrigerated may be placed on these shelves 24.

Figure 3:
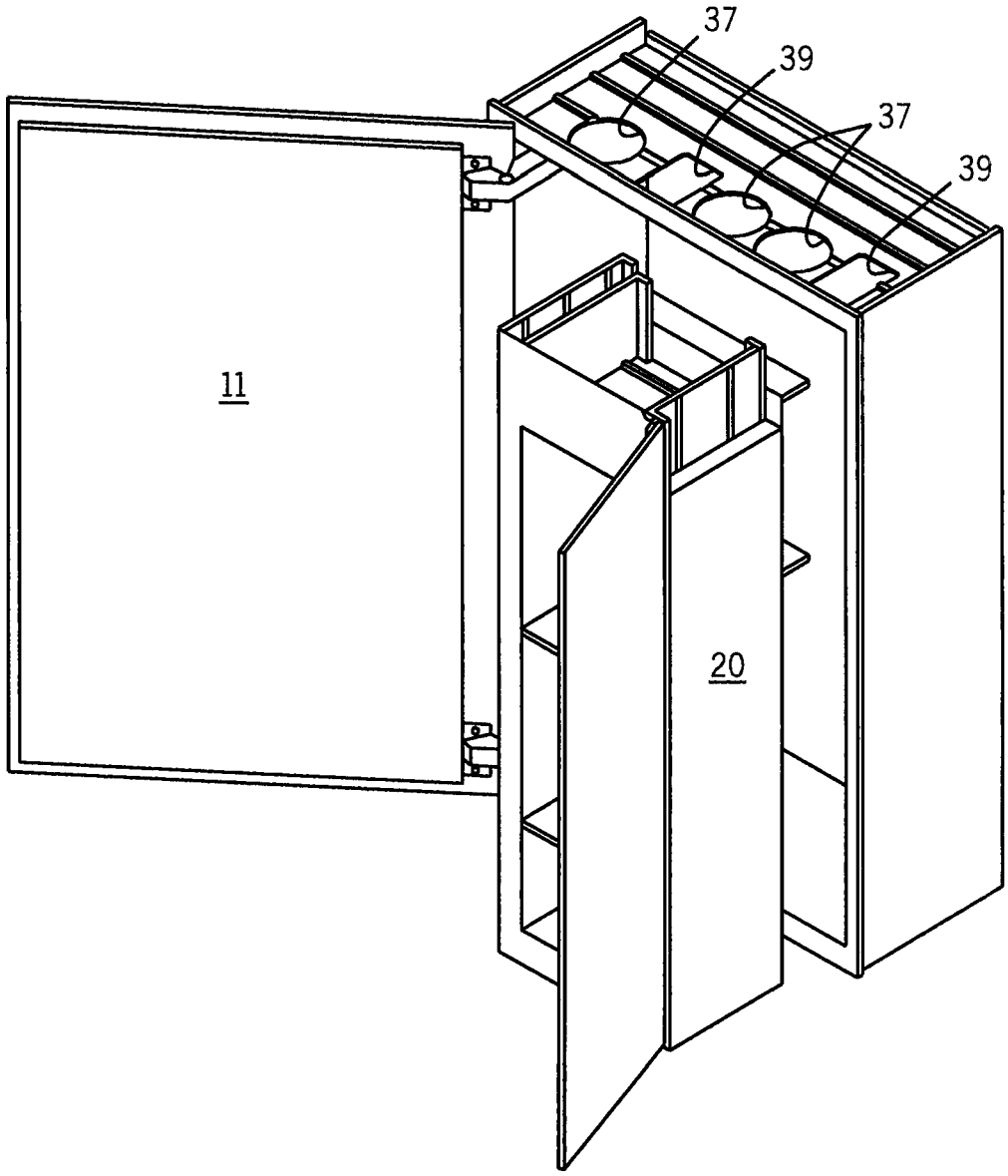
FIG. 3 is an exploded perspective view thereof.
Figure 4:
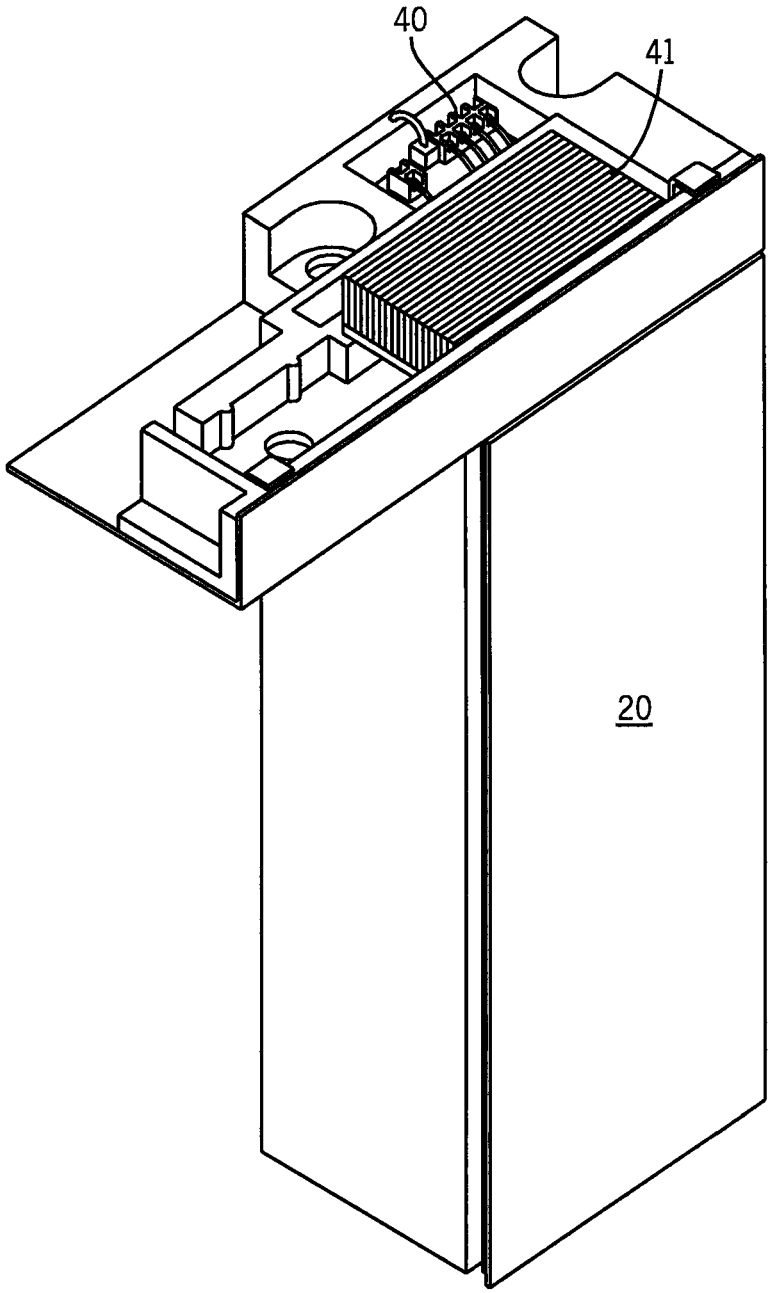
FIG. 4 is a perspective view of the refrigeration unit used in the medicine cabinet of FIG. 1.

As shown in FIGS. 3 and 4, the refrigeration cabinet can be a modular unit which can be installed and removed as a unit. It is preferably provided with a "Peltier" type refrigeration system. Such systems create a heat/cooling difference from an electric voltage when a current is passed through two dissimilar metals or semiconductors that are connected to each other at two junctions ("Peltier junctions").

The current drives a transfer of heat from one junction to the other. Thus, one junction will cool off while the other will heat up. When one attaches the junctions to a heat sink and a cooling sink, and places blowers adjacent each, a thermoelectric cooling system is achieved. If this is associated with a cooling sink is inside a confined space and the heat sink is exposed to the environment, a convention Peltier refrigerator is created.

FIG. 4 shows electrical controls 40 for such a Peltier refrigeration system, along with the finned heat sink 41. It is exposed to the air via vent 37 and exhaust 39 openings in the outer cabinet. Further, there preferably are conventional blower fans 60 to blow air through the vent openings 37 to remove the heat off the heat sink which exits the outer cabinet through the exhaust openings 39.

Figure 5:
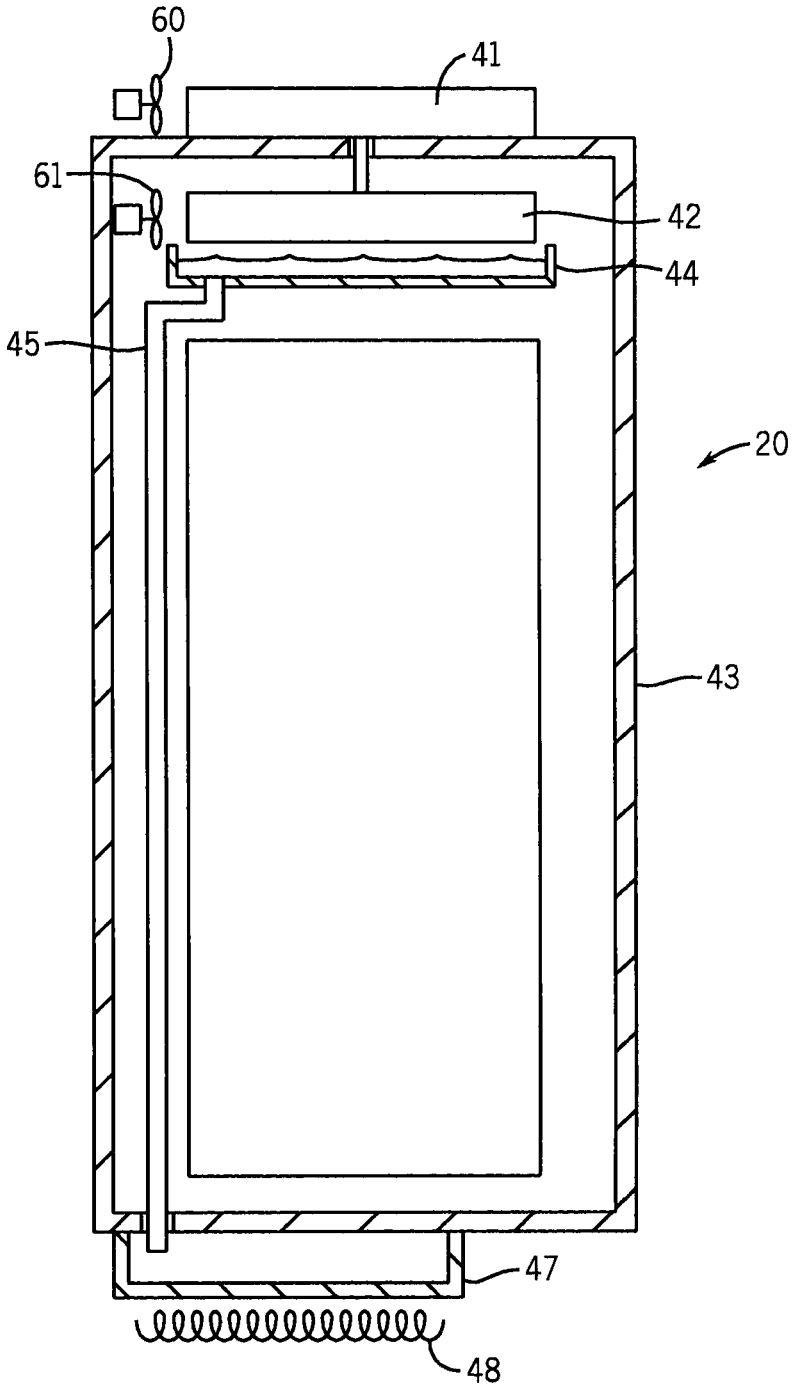
FIG. 5 is a schematic view of the condensation collection and disposal system of the present invention.

As schematically depicted in FIG. 5, the cooling sink 42 is inside the insulated cabinet 43. Air blowing or otherwise moving across it (e.g. using fan(s) 61) causes cold air to circulate within cabinet 43. There is a conventional temperature sensor inside the insulated cabinet, which feeds back to an electrical control system for the Peltier refrigeration system, to turn down the system as the desired temperature is reached, and to turn it back up as temperature rises above a selected level.

Under the cooling sink 42 is positioned a drip tray 44 that is sloped towards a collection conduit 45, which in turn carries condensed drippings outside the cabinet to a second drip tray 47. Under the second drip tray 47 is placed a 2 milliamp low voltage heater 48 to cause evaporation from the tray.

The second drip tray and associated heater are on the outside of the medicine cabinet, at a lower position behind a decorative frontal flange of the cabinet. Hence, they aren't readily visible. This system provides an effective way for dealing with condensation. It avoids the need for using a standard drip tray which may develop odors or bacteria, yet does not ornamentally disturb the design.

Further refinements can be made to this structure in alternative embodiments. For example, the separate ambient region could be eliminated (e.g. in favor of an expanded two chamber refrigeration cabinet with zonal temperature control). For example, one zone could be provided where the temperature would not exceed 25° C., albeit refrigeration below that did not occur. The second zone could be 15° or more cooler.

In another refinement, the first door could be designed to only cover an ambient region, and not double cover the refrigerated region. The refrigerated region could then have its own separate door. Like a side-by-side kitchen refrigerator/freezer this would provide the ability to access one region without accessing the other.

Therefore, the present invention is not to be limited to just the described preferred embodiments. Hence, to ascertain the full scope of the invention, the claims which follow should be referenced.

INDUSTRIAL APPLICABILITY

The present invention provides medicine cabinets which can store sensitive cosmetics and other common bathroom items at refrigerated temperatures.

We claim:

1. A wall-mountable medicine cabinet, comprising:

a vertically elongated housing having:

a first vertically elongated enclosable storage compartment therein;

a second vertically elongated enclosable storage compartment therein, which is laterally spaced apart from the first vertically elongated enclosable storage compartment; and a cavity therein, the cavity being positioned above the first vertically elongated enclosable storage compartment and being generally separated from the second vertically elongated enclosable storage compartment;

a refrigeration system configured to control a temperature within the first vertically elongated enclosable storage compartment but not the second vertically elongated enclosable storage compartment, the refrigeration system having a cooling device with a heat sink, the heat sink being positioned generally in the cavity; and at least one moveable door configured to cover an opening of at least one of the first vertically elongated enclosable storage compartment and the second vertically elongated enclosable storage compartment;

wherein the vertically elongated housing includes one or more openings positioned through an upper surface thereof and in fluidic communication with the cavity, the one or more openings being configured for removing heated air from the cooling device to outside the vertically elongated housing.

2. The medicine cabinet of claim 1, further comprising a drip pan positioned outside the vertically elongated housing to collect condensation therein.

3. The medicine cabinet of claim 2, further comprising a heater to evaporate the condensation collected in the drip pan.

4. The medicine cabinet of claim 2, further comprising a conduit for carrying the condensation from inside the vertically elongated housing to the drip pan.

5. The medicine cabinet of claim 4, further comprising an internally located drip pan to collect condensation therein, wherein the internal drip pan has a sloped configuration to direct the collected condensation into the conduit.

6. The medicine cabinet of 3, further comprising a decorative flange to cover the heater and external drip pan to improve aesthetics.

7. The medicine cabinet of claim 1, wherein the cavity is positioned above the second vertically elongated enclosable storage compartment.

8. The medicine cabinet of claim 7, wherein the openings are in the vertically elongated housing are positioned above both the first and second vertically elongated enclosable storage compartments.

9. The medicine cabinet of claim 1, wherein the wall-mountable medicine cabinet is configured to be suspended above a floor when mounted to a wall.

* * * * *